United States Patent [19]

Cashion, Jr.

[11] 4,225,646

[45] Sep. 30, 1980

[54] METHOD OF TREATING FIBERS AND FABRICS

[75] Inventor: James E. Cashion, Jr., Fountain Inn, S.C.

[73] Assignee: Pat-Chem, Inc., Greenville, S.C.

[21] Appl. No.: 37,364

[22] Filed: May 9, 1979

[51] Int. Cl.[3] ..... B05D 3/02; B32B 27/00

[52] U.S. Cl. ..... 428/290; 252/8.6; 252/8.9; 427/389.9; 427/393.2; 428/394; 528/296

[58] Field of Search ..... 8/115.5, 115.6, 115.7; 427/390 R, 390 C, 390 E; 428/290, 394, 395, 483; 528/296; 252/8.6, 8.9

[56] References Cited

U.S. PATENT DOCUMENTS

| | | | |
|---|---|---|---|
| 3,539,286 | 11/1970 | Bowers et al. | 8/115.5 |
| 3,652,502 | 3/1972 | Jackson et al. | 528/296 |
| 3,975,566 | 8/1976 | Holda et al. | 528/296 X |
| 4,035,531 | 7/1977 | Lark | 427/390 R |
| 4,073,993 | 2/1978 | Lark | 428/261 |
| 4,124,570 | 11/1978 | Scheibelhoffer et al. | 528/296 X |
| 4,145,469 | 3/1979 | Newkirk et al. | 428/245 |

*Primary Examiner*—Michael R. Lusignan

*Attorney, Agent, or Firm*—Bailey, Dority & Flint

[57] ABSTRACT

A method of improving the dimensional stability, crease resistance and surface appearance of fibers, fabrics and textile products of cotton, polyester-cotton blends, polyesters and polyester-synthetic blends comprises applying to the fiber, fabric or textile product, to a level of 2–4% by weight of added solids, a resin obtained in a two-step process from phthalic or isophthalic acid, trimethylolpropane and trimellitic anhydride and an alkanoic acid of 10–20 carbon atoms or a polyether glycol of molecular weight 500–700 and neopentyl glycol.

13 Claims, No Drawings

METHOD OF TREATING FIBERS AND FABRICS

BACKGROUND OF THE INVENTION

This invention relates to fiber and fabric finishes which impart dimensional stability, crease resistance and improved surface appearance to textile products made from cotton, polyester-cotton blends, polyesters, polyestersynthetic blends and the like.

The use of formaldehyde-derived products to improve the dimensional stability, crease resistance and appearance of fibers and fabrics is well known in the art of textile treatment.

Textiles treated with formaldehyde-containing resins have several disadvantages, including, in many cases, a harsh hand or feeling, an allergenic effect on some users and an increased tendency to pick up and hold oily soil. Bowers et al, U.S. Pat. No. 3,539,286 discloses that concurrent application of a formaldehyde resin, a low molecular weight polyoxyethylene terephthalate and an inorganic salt to polyester, cotton or rayon fibers greatly improves the soil resistance thereof.

Lark, U.S. Pat. No. 4,035,531 teaches that polyester fibers and filaments can be warp sized by application of a water-soluble polyester from a glycol of 2-6 carbon atoms and a polycarboxylic acid having at least three carboxyl groups. The resins have high acid numbers, greater than about 250. In addition, the resins improve the wettability characteristics, anti-static behavior and soil release tendencies of the fibers.

The use of a polyester resin based on isophthalic acid, polyether glycol, neopentyl glycol, trimethylolpropane and trimellitic anhydride in combination with a major proportion of starch in a sizing bath for polyester fibers used for sheeting is described by Amoco Chemicals Corp. (200 E. Randolph Drive, Chicago, Ill. 60601) in Bulletin IP-54.

Although the foregoing treating compositions solve one or more problems with respect to a specified type of fiber or fabric, their application effectively is generally limited to one type of fiber or fabric and the resulting treated fibers or fabrics may have one or several objectionable features, including allergenicity, poor hand, high soil retention, poor crease resistance, and low dimensional stability.

It is an object of this invention to provide a method of treating natural synthetic fibers, including but not limited to cotton, polyester-cotton blends, polyesters and polyester-synthetic blends, which imparts to the fibers or textile products made therefrom the dimensional stability, crease resistance and improved surface appearance normally associated with the use of formaldehyde resins and which further imparts to the fibers or fabrics improved hand, resistance to crocking and anti-snagging and anti-pilling properties.

SUMMARY OF THE INVENTION

In one aspect, this invention relates to a method of improving the dimensional stability, crease resistance and surface appearance of fibers, fabrics and textile products of cotton, polyester-cotton blends, polyesters, and polyestersynthetic blends, comprising applying to the fiber, fabric or textile product to a level of 2-4% by weight of added solids, a resin obtained from reaction between (a) 30-35% by weight of phthalic or isophthalic acid, 50-55% by weight of polyether glycol of molecular weight 500-700, 8-12% by weight of neopentyl glycol and 2-5% by weight of trimethylolpropane heated at 120-130 degrees C to produce an intermediate having an acid number of 1-17 and from a further reaction of the thus-produced intermediate with (b) 3-6% by weight of trimellitic anhydride at 160-190 degrees C to produce the resin having an acid number of 1-50.

In another aspect, this invention relates to a similar method employing as the treating resin a resin obtained from reaction between (a) 1.4-1.8 moles of phthalic or isophthalic acid, 1.0-1.25 moles of at least one alkanoic acid of 10-20 carbon atoms and 2.0-2.4 moles of trimethylolpropane heated at 120-130 degrees C, to produce an acid number of 1-17 and from a further reaction of the thus-produced intermediate with (b) 0.4-0.5 moles of trimellitic anhydride at 160-190 degrees C to produce a resin having an acid number of 40-70.

DETAILED DESCRIPTION

One resin used in the practice of this invention is obtained from 30-35% by weight phthalic or isophthalic acid, 50-55% by weight of polyether glycol of 500-700 molecular weight, 8-12% by weight of neopentyl glycol, 2-5% by weight of trimethylolpropane and 3-6% by weight of trimellitic anhydride.

In one method of preparing the resin, the combined glycols are heated to about 120 degrees C in a reaction vessel equipped for melt esterification. The phthalic or isophthalic acid is charged to the reaction vessel and the temperature is gradually raised to about 230 degrees C while the mixture is sparged with an inert gas and by-product water is removed. This phase of the reaction is continued until an intermediate resin, as used in the specification and claims, having an acid number of 1-17, is obtained. The thus-obtained intermediate is cooled to a temperature below about 180 degrees C prior to addition to the trimellitic anhydride. The reaction is continued at 160-190 degrees C until a product is obtained having an acid number between 1 and 50.

Contemplated equivalents of phthalic and isophthalic acids include methylterephthalic acid, the corresponding methyl and ethyl esters, and phthalic anhydride. A resin based on isophthalic acid is preferred.

Polyether glycols include polymers of 500-700 molecular weight obtained from alkylene oxides, including ethylene oxide, propylene oxide, oxetane and tetrahydrofuran. Polyether glycols derived from ethylene and propylene oxides are preferred, most preferably those from ethylene oxide. Exemplary of commercially available polyethylene glycols are the Carbowax products (Union Carbide Corp.). Preferably, the molecular weight of the polyether glycol is 550-650.

The preferred resins for use in the practice of this invention will have acid numbers near the higher limits specified for each step in the esterification. Thus, the preferred intermediate will have an acid number of 13-17 and the resinous product of reaction with trimellitic anhydride an acid number of 35-550.

Preferably, the resin will be obtained from 32-34% by weight of phthalic or isophthalic acid, 50-55% by weight of polyethylene glycol, 9-11% by weight of neopentyl glycol and 2-4% by weight of trimellitic anhydride.

The resin can be diluted with an organic solvent, e.g., propylene glycol proply ether, isopropanol, or any appropriate solvent that will aid in subsequent neutralization and dilution.

The solution can be neutralized with ammonia and diluted with water to a desired solids level, preferably 20–40% solids.

In the embodiment in which an alkanoic acid is used, the preferred acids are lauric and stearic acid or mixtures thereof in any proportions.

Contemplated equivalents of phthalic and isopthalic acids are as above, but isopthalic acid is preferred.

It is preferred that the acid number of intermediate resin be at the lower end of the recited range, preferably 1–10, and that the ultimate resin have an acid number of 50–65.

Preferably, the resin is obtained from reaction between (a) 1.4–1.8 moles of phthalic or isophthalic acid, 1.0–1.25 moles of at least one alkanoic acid of 10–20 carbon atoms and 2.0–2.4 moles of trimethylolpropane heated at 120–230 degrees C, to produce an acid number of 1–17 and from a further reaction of the thus-produced intermediate with (b) 0.4–0.5 moles of trimellitic anhydride at 160–190 degrees C to produce a resin having an acid number of 40–70.

The resin thus prepared can be diluted and neutralized as above.

For aqueous application, the resin must be neutralized with a suitable base, e.g., ammonium hydroxide, KOH, NaOH, or other nitrogen-containing baes. Depending on the physical properties desired, the durability of the finish, drying and curing conditions, and fiber composition, a subsequent crosslinking or insolubilization step employing a catalyst may be required. If solvent application is desired, neutralization will not be necessary.

Synthetics which can be blended with polyesters include rayon acetate, rayon acrylic. Polyesters include polyethylene terephthalate, and other fiber-forming products obtained by reaction between aromatic or aliphatic diols and aliphatic diacids.

The resin finish is applied by conventional techniques, including padding, spraying and kiss coating to the desired pick up of resin. A level of 2–4% by weight of added solids will be acceptable for the purposes of this invention, but a level of 2.5–3.5% by weight is preferred.

DESCRIPTION OF A PREFERRED EMBODIMENT

Most preferably, when a treating resin containing polyether glycol is used, the resin is that obtained from 32–34% by weight of isophthalic acid, 50–55% by weight of polyethylene glycol, 9–11% by weight of neopentyl glycol and 2–4% by weight of trimellitic anhydride, and the intermediate has an acid number of 13–17 and the resin has an acid number of 35–50.

When a treating resin containing an alkanoic acid is used, the most preferred resin is obtained from 1.5–1.7 moles of isophthalic acid, 1.1–1.2 moles of lauric acid, stearic acid or a mixture thereof, 21.–2.3 moles of trimethylolpropane and 0.45–0.5 moles of trimellitic anhydride and the intermediate has an acid number of 1–10 and the resin has an acid number of 50–65.

Without further elaboration, it is believed that one skilled in the art can, using the preceding description, utilize the present invention to its fullest extent. The following preferred specific embodiments are, therefore, to be construed as merely illustrative and not limitative of the remainder of the disclosure in any way whatsoever. In the following Examples, the temperatures are set forth uncorrected in degrees Fahrenheit; unless otherwise indicated, all parts and percentages are by weight.

EXAMPLE 1

Polyester resin was made from the following reactants:

| Parts by Weight | |
|---|---|
| 281.5 | isophthalic acid |
| 452.0 | polyether glycol (Carbowax 600, Union Carbide Corp. polyethylene oxide) |
| 78.0 | neopentyl glycol |
| 26.0 | trimethylolpropane |
| 36.0 | trimellitic anhydride |

The glycols were charged to a reaction vessel equipped for fusion esterification and heated to about 120 degree C., whereupon the isophthalic acid was charged to the vessel. The vessel was sparged with an inert gas while the temperature was gradually increased to about 230 degrees C. Volative by-products were collected by condensation. The temperature in the reaction vessel was maintained at about 230 degrees C until analysis of samples removed at periodic intervals indicated an acid number of 14–16. The vessel was cooled to about 175–180 degrees C and the trimellitic anhydride was charged to the vessel. Heating at about 180 degrees C was continued until an acid number of 40–45 was attained. The product was cooled and diluted with 194.5 parts by weight of propylene glycol propyl ether.

EXAMPLE 2

In the manner described in Example 1, a resin is made using 290 parts by weight of methylterephthalic acid instead of isophthalic acid.

EXAMPLE 3

In a manner described in Example 1, a resin was made from

| | Charge Weights |
|---|---|
| Isophthalic acid | 264.4 |
| Pelargonic acid | 180.4 |
| Trimethylol propane | 296.2 |
| Trimellitic anhydride | 87.5 |
| | 878.5 |

EXAMPLE 4

As described in Example 1, resins were made from the following charges:

| | 160A | 162B | 174C |
|---|---|---|---|
| isophthalic acid | 1.60 | 1.60 | 1.60 |
| lauric acid | 1.14 | | 0.57 |
| stearic acid | | 1.14 | 0.57 |
| trimethylolpropane | 2.2 | 2.2 | 2.2 |
| trimellitic anhydride | 0.46 | 0.46 | 0.46 |
| intermediate acid no. | <10 | <10 | <10 |
| final resin acid no. | 60–65 | 60–65 | 53–57 |

The resins were diluted with isopropanol to a solids content of about 75%.

EXAMPLE 5

Resins prepared as in Examples, 1, 3 and 4 and having an intermediate acid no. of 14.8 and a final acid number of 39.0 were diluted with water to a solids level of 2.4% and applied by padding to polyester-cotton sheeting (65–35) and cured at 300 degrees F. Fabric was washed in accordance with AATCC Test Method 96–1975. The treated samples were checked for warp shrinkage after repeated washings.

Results were:

| Resin | % Shrinkage in warp |
|---|---|
| Example 3 | 1.1 |
| Example 4–160A | 1.25 |
| Example 4–162A | 1.1 |
| Example 1–130 | 1.0 |
| Example 4–174C | 1.23 |
| Untreated (control) | 1.87 |

These results indicate that the resins used in the practice of this invention improve the dimensional stability of polyester-cotton blends.

EXAMPLE 6

Sample swatches of cotton-polyester blends (35–65) and 100% cotton were impregnated with polyesters prepared in accordance with Examples 1, 3 and 4, having an intermediate acid no. of 14.8 and a final acid no. of 39.0. The resin designated 101 was prepared in Example 3 from isophthalic acid, pelargonic acid, trimethylol propane and trimelletic anhydride. The resin designated 130 was prepared according to Example 1. Product 6304 is an acrylic acid copolymer from Celanese and Softener 1442 is a fatty based softener from Pat-Chem, Inc.

The resins were diluted to 2.4% solids with water after neutralization with potassium hydroxide to pH 6.5.

The treating solutions were applied by conventional pad-squeeze procedure and dry-cured for 5 minutes at 300 degrees F.

| Resin | % Level | Fabric | % Shrinkage Wp. | % Shrinkage Flg. |
|---|---|---|---|---|
| A: 130 | 8[a] | polyester-cotton | 1.8 | 1.5 |
| 130 | 8[b] | " | 1.9 | 1.6 |
| Control | | " | 2.6 | 2.1 |
| B: 130 | 6 | polyester-cotton drapery fabric | 0.625 | |
| Control | | polyester-cotton drapery fabric | 0.625 | |
| 101 | 6 | polyester-cotton drapery fabric | 0.625 | |
| 101 | 12 | polyester-cotton drapery fabric | 0.31 | |
| 130 | 12 | polyester-cotton drapery fabric | 0.31 | |
| C: 130 | 12 | 100% cotton | 3.75 | |
| 101 | 12 | " | 5.0 | |
| 130 | 6 | " | 5.6 | |
| 101 | 6 | " | 4.7 | |
| Control | | " | 5.6 | |

[a]handbuilder
[b]handbuilder and softener

It will be apparent that the resins described above are most effective for reducing shrinkage of 100% cotton.

EXAMPLE 7

Samples of polyester-cotton (50–50) and 100% cotton were impregnated with polyester resins prepared in accordance with Examples 1 and 3 and having an intermediate acid no. of 14.9 and a final acid no. of 39.3. The polyester resins were run against American Cyanamid Resin 900, which is representative of conventional glyoxal resins. The polyester resins were neutralized and diluted to 2–4% solids, applied by the pad-squeeze method and dry-cured at 300 degrees F for 5 minutes. The Resin 900 was catalyzed with MgC12, dried at 250 degrees F and cured for 1.5 minutes at 340 degrees F. The treated samples were washed 5 times according to AATCC Test Method 96–1975 and measured for dimensional stability after 1, 3 and 5 washings.

| | | | % Shrinkage 1x | | 3x | | 5x | |
|---|---|---|---|---|---|---|---|---|
| Resin % | Level | Fabric | WP | Flg. | Wp | Flg | Wp* | Flg** |
| Resin 900 | 16 | 50–50 polyester-cotton | .0 | .32 | .15 | .31 | .32 | .625 |
| Resin 900 | 8 | | | | | | | |
| Resin 130 | 4 | 50–50 polyester-cotton | — | — | .31 | .93 | .47 | .93 |
| Resin 130 | 8 | 50–50 polyester-cotton | .78 | .45 | 1.25 | .625 | 1.25 | .94 |
| Control | — | 50–50 polyester-cotton | 1.09 | .45 | 1.40 | .94 | 1.70 | 0.94 |
| Resin 900 | 16 | 100% cotton | 1.09 | .94 | 1.09 | .94 | 1.4 | 1.09 |
| Resin 900 | 8 | | | | | | | |
| Resin 130 | 4 | " | 1.25 | 1.09 | 1.25 | .78 | 1.4 | .78 |
| Resin 130 | 8 | " | 3.90 | 1.25 | 5.0 | 1.4 | 5.78 | 1.4 |
| Resin 130 | 8 | | | | | | | |
| $MgCl_2$ | 2 | " | 2.65 | .78 | 3.12 | .94 | 3.75 | .78 |
| Resin 130 | 8 | | | | | | | |
| Resin 101 | 4 | " | 3.27 | — | 4.06 | — | 5.12 | — |
| Control | — | " | 3.90 | .94 | 5.15 | .94 | 5.94 | .94 |

*Wp = warp
**Flg = filling

The dried samples were washed three times in accordance to ATTCC Method 96–1975 and evaluated for shrinkage. Results were:

EXAMPLE 8

Resins prepared as in Example 6 were compared with resin designated "900" from American Cyanamid, which is an unbuffered glyoxal-based resin.

The resins of Example 6 had an intermediate acid no. of 15 and a final acid no. of 42. They were diluted with water to 2.4% solids after being neutralized with sodium hydroxide to pH 7.

The resins were applied to 65/35 polyester/cotton by padding and cured at varying temperatures from 250 degrees F to 340 degrees F. The samples were then padded through a 10% $CaCl_2$ solution and dried at 250 degrees F.

The samples were evaluated after washing cycles as in Example 6. Results were:

| | | | | % shrinkage | |
|---|---|---|---|---|---|
| Resin | % resin | % salt | | Warp | Filling |
| 130 | 8 | 10% $CaCl_2$ | 250° F. | 0.625 | 0.5 |
| 130 | 8 | 10% $CaCl_2$ | 300° F. | 0.75 | 0 |
| 130 | 8 | 10% $CaCl_2$ | 340° F. | .69 | 0.31 |
| 130 | 8 | 10% $Ca(Ac)_2$ | 300° F. | 1.44 | 1.25 |
| 130 | 8 | 5% $CaCl_2$ | 300° F. | 1.19 | 1.06 |
| 101 | 8 | 10% $CaCl_2$ | 300° F. | 0.75 | 0.56 |
| 162 | 8 | 10% $CaCl_2$ | 300° F. | 0.94 | 0.625 |
| 900 | 12 | 3% $MgCl_2$ | 350° F. | 0.625 | 0.625 |
| 130 | 8 | 10% $MgCl_2$ | 300° F. | 1.06 | 0.625 |
| control | — | — | 300° F. | 1.75 | 1.19 |

Accordingly, addition of inorganic salts to the resins used in the practice of this invention gives improvement in dimensional stability.

The preceding examples can be repeated with similar success by substituting the generically or specifically described reactants and/or operating conditions of this invention for those used in the preceding examples.

From the foregoing description, one skilled in the art can easily ascertain the essential characterstics of this invention and, without departing from the spirit and scope thereof, can make various changes and modifications of the invention to adapt it to various usages and conditions.

What is claimed is:

1. A method of improving the dimensional stability, crease resistance and surface appearance of fibers, fabrics and textile products of cotton, polyester-cotton blends, polyesters and polyester-synthetic blends, comprising applying to the fiber, fabric or textile product, to a level of 2–4% by weight of added solids, a resin obtained from reaction between (a) 30–35% by weight of phthalic or isophthalic acid, 50–55% by weight of polyether glycol of molecular weight 500–700, 8–12% by weight of neopentyl glycol and 2–5% by weight of trimethylolpropane heated at 120–130 degrees C to produce an intermediate having an acid number of 1–17 and from a further reaction of the thus-produced intermediate with (b) 3–6% by weight of trimellitic anhydride at 160–190 degrees C to produce the resin having an acid number of 1–50.

2. The method of claim 1, wherein the intermediate has an acid number of 13–17 and the resin has an acid number of 35–50.

3. The method of claim 1, wherein the polyethyer glycol is polyethylene glycol.

4. The method of claim 1, wherein the resin is obtained from 32–34% by weight of phthalic or isophthalic acid, 50–55% by weight of polyethylene glycol, 9–11% by weight of neopentyl glycol and 2–4% by weight of trimellitic anhydride.

5. The method of claim 4, wherein the intermediate has an acid number of 13–17 and the resin has an acid number of 35–50.

6. The method of claim 4, wherein the resin is obtained from isophthalic acid and the intermediate has an acid number of 13–17 and the resin has an acid number of 35–50.

7. A method of improving the dimensional stability, crease resistance and surface appearance of fibers, fabrics and textile products of cotton, polyester-cotton blends, polyesters and polyester-synthetic blends, comprising applying to the fiber, fabric of textile product to a level of 2–4% by weight of added solids a resin obtained from reaction between (a) 1.4–1.8 moles of phthalic or isophthalic acid, 1.0–1.25 moles of at least one alkanoic acid of 10–20 carbon atoms and 2.0–2.4 moles of trimethylolpropane heated at 120–130 degrees C, to produce an acid number of 1–17 and from a further reaction of the thus-produced intermediate with (b) 0.4–0.5 moles of trimellitic anhydride at 160–190 degrees C to produce a resin having an acid number of 40–70.

8. The method of claim 7, wherein the intermediate has an acid number of 1–10 and the resin has an acid number of 50–65.

9. The method of claim 7, wherein the alkanoic acid is lauric acid, stearic acid or a mixture thereof.

10. The method of claim 7, wherein the resin is obtained from 1.5–1.7 moles of phthalic or isophthalic acid, 1.1–1.2 moles of alkanoic acid, 2.1–2.3 moles of trimethylolpropane and 0.45–0.5 moles of trimellitic anhydride.

11. The method of claim 10, wherein the intermediate has an acid number of 1–10 and the resin has an acid number of 50–65.

12. The method of claim 10, wherein the intermediate has an acid number of 1–10 and the resin has an acid number of 50–65 and the alkanoic acid is lauric acid, stearic acid, or a mixture thereof.

13. The method of claim 10, wherein the resin is obtained from isophthalic acid; the intermediate has an acid number of 1–10 and the resin has an acid number of 50–65; and the alkanoic acid is lauric acid, stearic acid or a mixture thereof.

* * * * *